US009693641B2

(12) United States Patent
Brown

(10) Patent No.: US 9,693,641 B2
(45) Date of Patent: Jul. 4, 2017

(54) STRESS-RELIEF DISPLAY HANGER

(71) Applicant: R&J Manufacturing Company, Johnston, RI (US)

(72) Inventor: David W. Brown, Cumberland, RI (US)

(73) Assignee: R&J Manufacturing Company, Johnston, RI (US)

( * ) Notice: Subject to any disclaimer, the term of this patent is extended or adjusted under 35 U.S.C. 154(b) by 0 days.

(21) Appl. No.: 14/936,151

(22) Filed: Nov. 9, 2015

(65) Prior Publication Data

US 2016/0128493 A1 May 12, 2016

Related U.S. Application Data

(60) Provisional application No. 62/076,963, filed on Nov. 7, 2014.

(51) Int. Cl.
*A47F 5/00* (2006.01)
*B65D 73/00* (2006.01)

(52) U.S. Cl.
CPC ..... *A47F 5/0006* (2013.01); *B65D 73/0071* (2013.01); *B65D 2203/10* (2013.01)

(58) Field of Classification Search
CPC ..... A47F 5/0006; A47F 4/02; B65D 73/0071; B65D 2203/10
USPC ..... 248/300, 317, 318, 323, 340, 467, 692; 206/278, 299, 449, 466, 485, 495, 525, 206/6.1; 340/572.8; 428/343, 354, 428/317.3; 380/22, 23
See application file for complete search history.

(56) References Cited

U.S. PATENT DOCUMENTS 2,995,845 A * 8/1961 Fraser ..... G09F 3/12 206/278
3,065,946 A 11/1962 Berkow
3,339,721 A * 9/1967 Goldstein ..... B65D 33/02 206/499
3,382,970 A * 5/1968 Sellors ..... A47F 5/112 206/45.24
3,471,006 A * 10/1969 Tempelhof ..... B65D 5/008 206/449
3,884,443 A * 5/1975 McMaster ..... A47G 1/17 24/67 AR
D271,943 S * 12/1983 Beise ..... D9/415
4,832,207 A * 5/1989 Alexander ..... A47F 5/0068 206/449
5,078,264 A 1/1992 Garganese
5,083,700 A * 1/1992 Mello ..... B65D 5/4204 206/806

(Continued)

*Primary Examiner* — Muhammad Ijaz
(74) *Attorney, Agent, or Firm* — McInnes & McLane, LLP

(57) ABSTRACT

A display hanger is disclosed including a first and a second panel, at least one stress-relief member formed in one of the first or second panel, the stress-relief member having an inner surface that is secured to an inner surface of an opposing panel of the hanger, for example by an adhesive. The at least one stress-relief member moves stress away from the leading edge of the adhesive and more evenly distributes the stress across a wider area of the base of the display hanger. This results in the adhesive being under lower stress, which reduces adhesive failure in less than desirable situations since the display hanger material becomes the point on failure instead of the adhesive bond.

21 Claims, 8 Drawing Sheets
(1 of 8 Drawing Sheet(s) Filed in Color)

(56) References Cited

U.S. PATENT DOCUMENTS

| | | | | | |
|---|---|---|---|---|---|
| 5,328,137 | A * | 7/1994 | Miller | B65D 73/0028 | 248/205.3 |
| D368,591 | S | 4/1996 | Doyle | | |
| 5,593,025 | A * | 1/1997 | Feibelman | A47F 7/02 | 206/495 |
| 5,775,504 | A | 7/1998 | Menaged | | |
| 5,975,294 | A * | 11/1999 | Hsi-Chang | B65D 73/0078 | 206/349 |
| 5,982,284 | A | 11/1999 | Baldwin et al. | | |
| 6,073,758 | A | 6/2000 | Webster et al. | | |
| 6,254,953 | B1 | 7/2001 | Elston | | |
| 6,433,686 | B1 | 8/2002 | Feibelman | | |
| 6,471,053 | B1 * | 10/2002 | Feibelman | A47F 7/02 | 206/495 |
| 6,724,311 | B1 | 4/2004 | Kolton et al. | | |
| 7,015,815 | B1 * | 3/2006 | Feibelman | A47F 5/0006 | 206/6.1 |
| 7,451,873 | B2 * | 11/2008 | Chow | B65D 73/0064 | 206/389 |
| 7,762,398 | B2 * | 7/2010 | Tokie | B65D 23/005 | 206/459.5 |
| 2003/0196920 | A1 * | 10/2003 | Curtsinger | B23D 59/00 | 206/349 |
| 2010/0084353 | A1 * | 4/2010 | Barker | A47F 5/0006 | 211/34 |
| 2013/0308880 | A1 * | 11/2013 | Jenkins | B65D 73/0014 | 383/22 |
| 2015/0196141 | A1 * | 7/2015 | Rohrig | B65D 73/0085 | 248/318 |

* cited by examiner

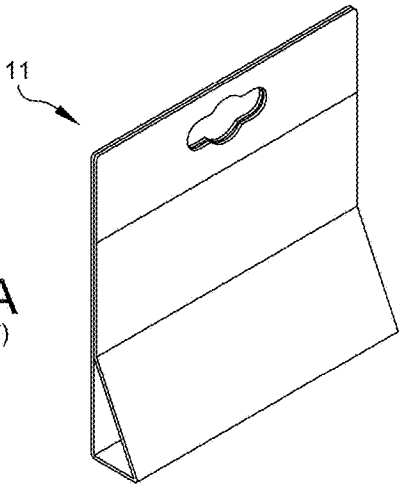
FIG. 1A
(PRIOR ART)
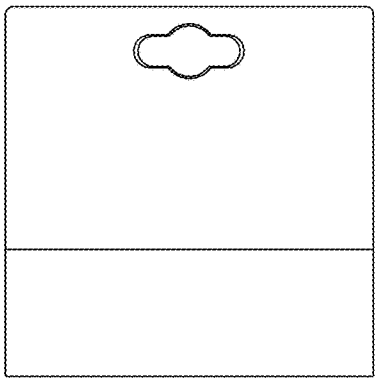
FIG. 1B
(PRIOR ART)
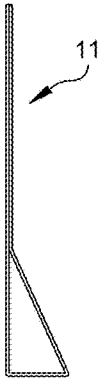
FIG. 1C
(PRIOR ART)
FIG. 1D
(PRIOR ART)
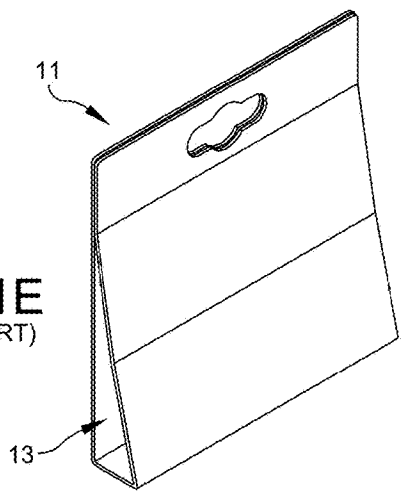
FIG. 1E
(PRIOR ART)
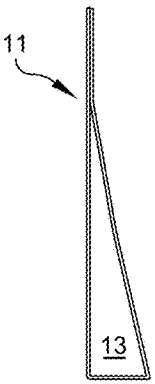
FIG. 1F
(PRIOR ART)

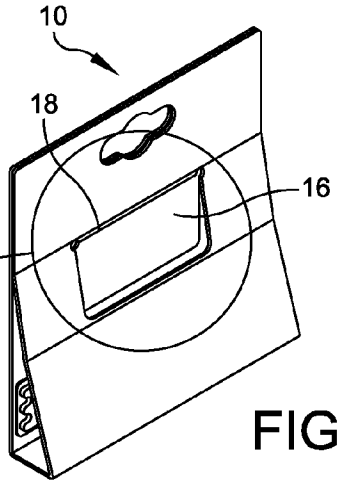
FIG. 3A
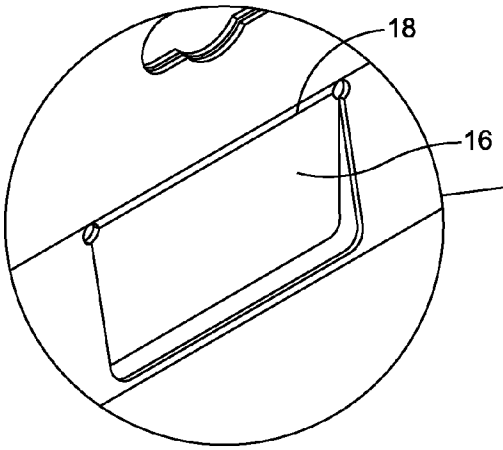
FIG. 3B
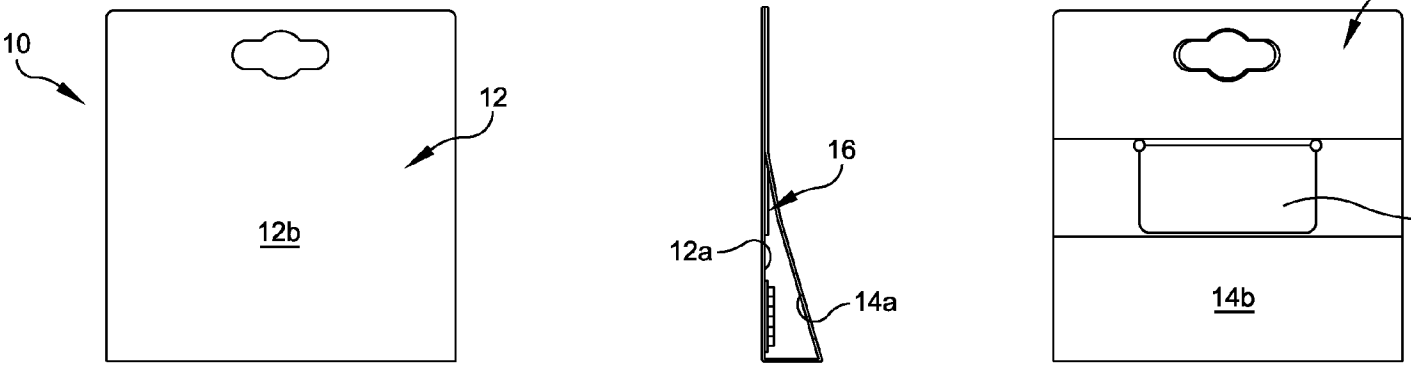
FIG. 3C
FIG. 3D
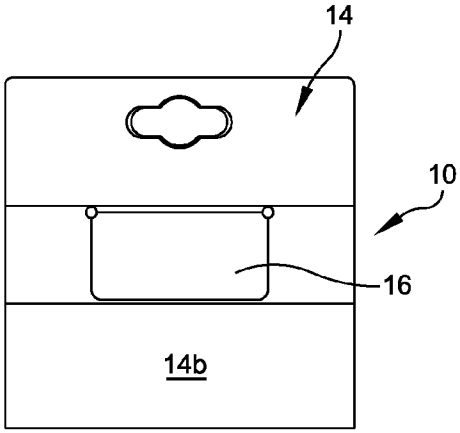
FIG. 3E

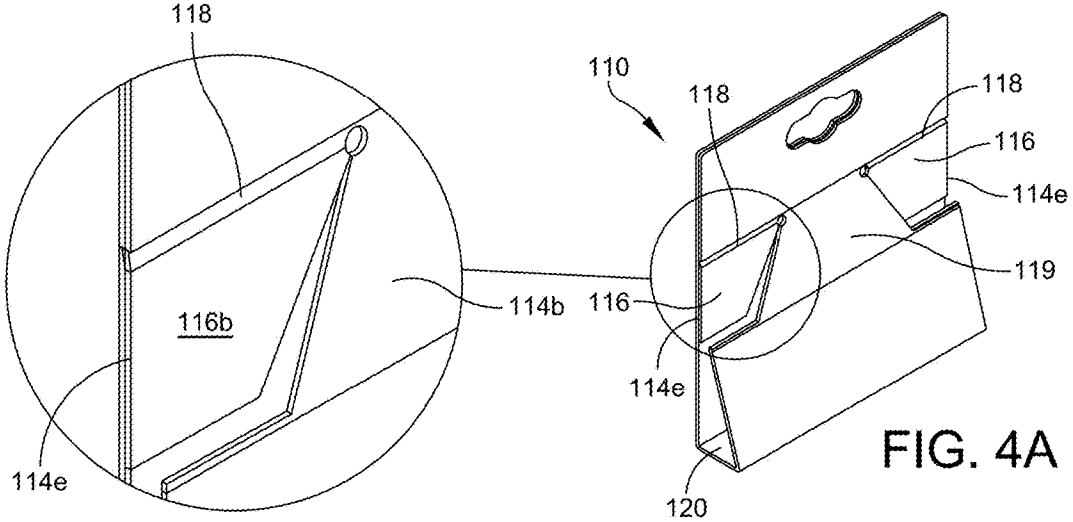
FIG. 4A
FIG. 4B
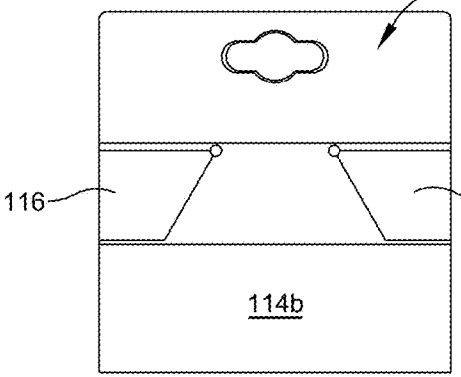
FIG. 4E
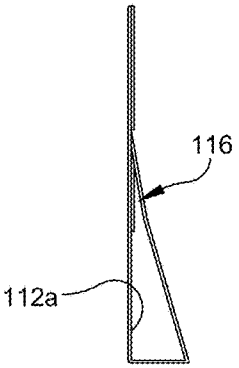
FIG. 4D
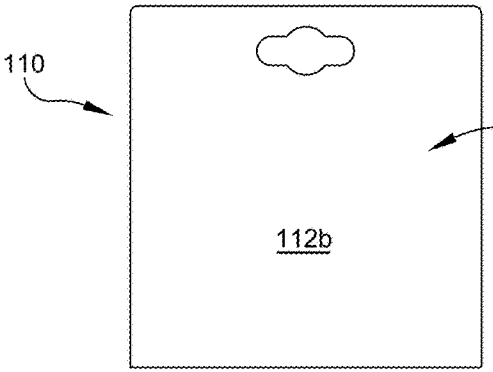
FIG. 4C

STRESS-RELIEF DISPLAY HANGER

CROSS-REFERENCE TO RELATED APPLICATIONS

This application claims the benefit of priority to U.S. Provisional Patent Application No. 62/076,963, filed Nov. 7, 2014 and entitled "Stress Relief Display Hanger," which is herein incorporated by reference in its entirety.

TECHNICAL FIELD

This disclosure relates generally to a display hanger and, more specifically to an improved display hanger for supporting an article, the display hanger having built-in stress-relief to distribute force across the display hanger to reduce adhesion failure and avoid separation of the display hanger.

BACKGROUND OF RELATED ART

Retailers utilize a variety of devices in order to display and discourage theft of their goods. For example, display hangers are often utilized to support an article being sold by hanging it on a display unit. One type of display hanger used for displaying fashion accessories is a "fold-over" display hanger, so named because the hanger begins as a flat sheet that is cut into a particular shape which is then folded over and secured with adhesive to create the display hanger. The folding, or creasing of the sheet is generally done by hand, and the number of creases or folds can vary greatly depending upon the design of the display hanger. This type of display hanger can be utilized for a variety of accessory items, such as scarfs, hair accessories, necklaces and the like, is cost effective and utilizes minimal display space at retail with optimal product exposure. Two such display hangers are disclosed in U.S. Pat. Nos. 5,593,025 and 7,015,815, which are also owned by the Applicant of the present disclosure.

Display hangers may optionally incorporate an electronic article surveillance (EAS) sensor, or other security sensor such as an RFID sensor, that is attached to the display hanger. These types of sensors are typically secured to the hanger and are either removed or rendered inactive at checkout. One common form of EAS sensors is a flat, thin, flexible rectangular member that is applied adhesively to a flat or curved exterior surface of the article or the hanger. In some cases the sensors are visible to consumers, and in other cases the sensors are hidden from view in order to prevent unauthorized removal. In either case, if the sensors are not rendered inactive or removed, they will be sensed by the system causing an alarm to signal to be activated, for example when the consumer exits the store. Article display hangers having security sensors perform the function of both supporting and displaying the article while also protecting it from theft.

SUMMARY

Conventional fold-over display hangers begin flat, may be assembled by hand, can be made from coated cardboard or plastic, and secured by adhesive once folded. FIGS. 1A-1D illustrate one example of a conventional fold-over display hanger (11). Since fold-over display hangers are assembled by hand, inconsistent assembly can occur which may lead to failure in the retail environment. The most common type of failure is that of the adhesive bond securing the inner surfaces together. Failure of the adhesive bond may result from a lack of consistent and sufficient bonding by the assembly worker, overloading of the fold-over hanger by placing an overly heavy accessory item in a too-small fold-over hanger, the use of foam inside the fold-over hanger which can generate a spring-like force against the leading edge of the adhesive bond, environmental conditions such as extreme heat (especially in overseas shipping containers), to name a few examples of factors that may contribute to the degradation and/or failure of the adhesive.

It has been discovered that adhesive failures most commonly occur as a wedge at the leading edge of the adhesive bond where higher stresses often occur causing separation (i.e., leading edge adhesive failure). FIGS. 1E-1G illustrate such a prior art separation wedge (13), which can ultimately result in failure of the adhesive (15).

In order to relieve the stress in the area of the leading edge to prevent a separation wedge from forming, the display hanger of the present application includes a first and a second panel, at least one stress-relief member or tab formed in at least one of the first or second panel of the display hanger, the at least one stress-relief member having an inner surface that is secured to an inner surface of an opposing panel of the hanger, for example by an adhesive substance. The provision of at least one stress-relief tab in one panel of the display hanger moves the stress point away from the leading edge of the adhesive and more evenly distributes the force across a wider area of the base of the display hanger, with no "wedge effect" to cause adhesive separation. The result is that the adhesive is under lower stress, thus allowing the fold over to perform without failure in less than desirable situations because the display hanger material becomes the point on failure instead of the adhesive bond.

In one embodiment, the at least one stress-relief member is a single tab that is generally centrally located from either edge of the second or rear panel, and may have a generally rectangular or somewhat arcuate or curved shaped, or other shape as may be appropriate.

In another embodiment, the at least one stress-relief tab includes a pair of side stress-relief tabs that are located on either side of the rear panel and extend inwardly from either edge, the side tabs having a generally rectangular or somewhat arcuate or curved shape, or other shape as may be appropriate.

The stress-relief display hanger described herein provides the functionality and other advantages associated with a conventional fold-over display tag while providing reduced stress at the leading edge of the adhesive to provide for a more secure display tag with reduced chance of failure. The lower stress also allows for the use of lower strength adhesive with performance that has been shown to outperform conventional fold-over display hangers in a side-by-side test.

BRIEF DESCRIPTION OF THE DRAWINGS

The patent or application file contains at least one drawing executed in color. Copies of this patent or patent application publication with color drawing(s) will be provided by the Office upon request and payment of the necessary fee. Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments, and are incorporated in and constitute a part of this specification, but are not intended as a definition of the limits of any particular embodiment. The figures, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure.

FIG. 1A is a rear perspective view of a prior art fold-over display hanger with adhesive in place;

FIG. 1B is a front elevational view of a prior art fold-over display hanger of FIG. 1A;

FIG. 1C is a side elevational view of a prior art fold-over display hanger of FIG. 1A;

FIG. 1D is a rear elevational view of a prior art fold-over display hanger of FIG. 1A;

FIG. 1E is a rear perspective view of the prior art fold-over display hanger of FIG. 1A with the adhesive separating and failing;

FIG. 1F is a side elevational view of the prior art fold-over display hanger of FIG. 1E;

FIG. 3A is a rear perspective view of a first embodiment of a stress-relief display hanger of the present disclosure having a single stress-relief tab;

FIG. 3B is an exploded rear view of the stress-relief tab of the embodiment of FIG. 3A;

FIG. 3C is a front elevational view of the embodiment of FIG. 3A;

FIG. 3D is a side elevational view of the embodiment of FIG. 3A;

FIG. 3E is a rear elevational view of the embodiment of FIG. 3A;

FIG. 4A is a rear perspective view of a second embodiment of a stress-relief display hanger of the present disclosure having a pair of stress-relief tabs;

FIG. 4B is an exploded rear view of a stress-relief tab of the embodiment of FIG. 4A;

FIG. 4C is a front elevational view of the embodiment of FIG. 4A;

FIG. 4D is a side elevational view of the embodiment of FIG. 4A;

FIG. 4E is a rear elevational view of the embodiment of FIG. 4A;

DETAILED DESCRIPTION OF THE ILLUSTRATIVE EMBODIMENTS

Figure 2:
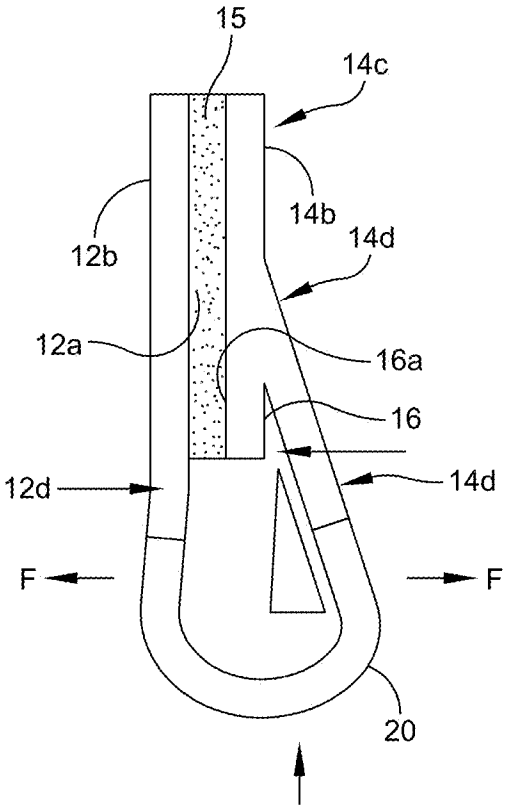
FIG. 2 is a schematic of a stress-relief display hanger of the present disclosure illustrating that the wedge effect has been removed from the leading edge of the bond.

The phraseology and terminology used herein is for the purpose of description and should not be regarded as limiting. Any references to examples, embodiments, components, elements or devices described herein referred to in the singular may also embrace embodiments including a plurality, and any references in plural to any embodiment, component, element or device herein may also embrace embodiments including only a singularity. References in the singular or plural form are not intended to limit the presently disclosed device, its components, structure, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, as used herein the term "article" refers to any item or product supported on a display hanger, and is not limited to the particular articles disclosed herein. As also used herein, the terms "EAS sensor" or "EAS marker" are used in the conventional sense to mean any of a number of electronic article surveillance sensors, as would be known to those of skill in the art. For example, the EAS sensor may comprise a ferro magnetic member. EAS sensors are widely available and may be purchased from such companies as Sensormatic Electronics Corporation of Boca Raton, Fla., but are not limited thereto and may include any other type of sensor for deterring theft of an article.

A first embodiment of a stress-relief display hanger 10 for supporting an article such as a necklace, jewelry, scarf, hair accessories, or the like, is illustrated in FIGS. 3A-3E. Display hanger 10 may be a fold-over style hanger that is folded, pleated or creased during assembly into a desired shape, the shape and number of folds, pleats, or creases being variable, depending upon the desired display hanger design, as would be known to those of skill in the art. Stress-relief display hanger 10 includes a first or front panel 12 having an inner surface 12*a* and an outer surface 12*b*, a second or rear panel 14 also having an inner surface 14*a*, an outer surface 14*b* and at least one stress-relief member 16 formed in the rear panel 14, in the present embodiment. The at least one stress-relief member 16 may be formed in the rear panel 14 by cutting a portion of the rear panel 14, between the inner surface 14*a* and the outer surface 14*b* into a desired shape, for example a generally rectangular tab, as shown, or into other desired shapes. The at least one stress-relief member 16 also includes an inner surface 16*a* (FIG. 2) and an outer surface 16*b*. The inner surface 16*a* of the at least on stress-relief member 16 is adhered to the inner surface 12*a* of the front panel 12 when assembled. The inwardly flexing, at least one stress-relief member 16 flexes inward toward the inner surface 12*a* independently of the rear panel 14 when the stress-relief display hanger is subjected to forces "F", as described in greater detail below.

In the present embodiment, the stress-relief tab 16 is a single tab that is generally centrally located from either edge 14*e* of the rear panel. The at least one stress-relief tab 16 may also include a hinged portion 18 that aids in allowing the stress-relief tab 16 to flex inward, toward the inner surface 12*a* of front panel 12. Either side of the hinged portion 18 may optionally also include a pair of openings or holes 17 on either end of the hinged portion 18 that may be provided to help prevent tearing of the stress-relief tab 16. Holes 17 are optional and may be eliminated, as desired. An EAS marker (not shown) may also optionally be secured to the display hanger 10, on any of the inner surfaces 12*a*, 14*a*, outer surfaces 12*b*, 14*b*, or base 20, in order to deter theft of the display hanger and the article, as would be known to one of skill in the art.

Referring now to FIGS. 2 and 3E, in order to secure a portion of the front panel 12 and a portion of the rear panel 14 in the assembled position, an adhesive may be disposed on a selective area of the inner surface 12*a* of the front panel, on a selective area of the inner surface 14*a* of the rear panel, or on both inner surfaces 12*a*, 14*a*. The selective area of adhesive includes a first area that is either disposed on at least a portion of the inner surface 16*a* of the stress-relief tab 16 itself, or on the inner surface 12*a*, 14*a* of the opposing panel 12, 14 to which the stress-relief tab 16 is secured during use, as described above. In the present embodiment, in addition to the first area of adhesive that secures the stress-relief tab 16 to the inner surface 12*a* of the front panel 12, an area that is above the stress-relief tab 16, namely upper portion 12*c* and 14*c* of the display hanger 10, is secured together, again for example, by adhesive being placed on the inner surfaces of one or both of the upper portions 12*c*, 14*c*. Alternate methods of securing may be utilized other than adhesive, as would be known to those of skill in the art. Additionally, an area of the display hanger 10 that is adjacent the stress-relief tab 16 may also optionally include adhesive 15, if desired. In the present embodiment, the portion of the display hanger 10 beneath or below the at least one stress-relief tab 16, i.e. lower portions 12*d*, 14*d*, are not secured to each other such that the area of the lower portions 12*d*, 14*d* of the front panel 12 and rear panel 14 are spaced at a distance from each other, in order to create an opening or void 26 for receiving the article to be supported therein.

Figure 1G:
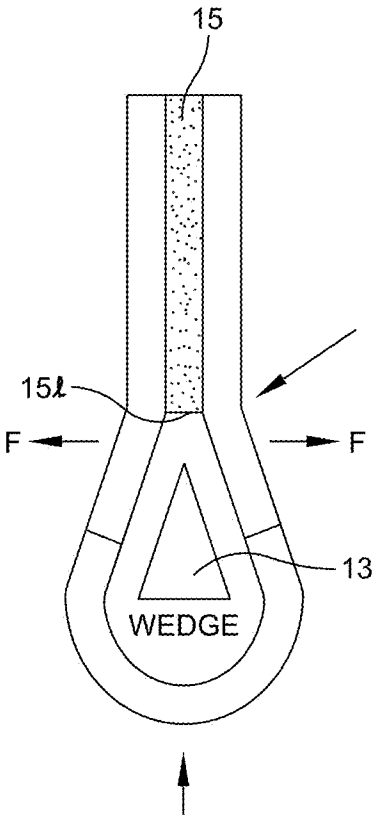
FIG. 1G (PRIOR ART)
FIG. 1G is a schematic of a prior art fold-over display hanger illustrating leading edge stresses and wedge effect at the leading edge of the adhesive bond.

As shown in FIGS. 1G and 2, the adhesive 15 securing the inner surface 16*a* of the at least one stress-relief tab 16 moves the primary stress point away from the leading edge of the adhesive 151 (prior art FIG. 1G) and more evenly distributes the force "F" across a wider area of a base 20 of the display hanger 10, with no "wedge effect" causing adhesive separation. The result is that the adhesive is under lower stress allowing the display hanger to perform in less than desirable situations without failure because the display hanger material becomes the point of failure, instead of the adhesive bond. In addition to helping prevent inadvertent separation due to adhesive failure, another benefit of utilization of the stress relief tab 16 is that it makes it more difficult for a consumer to separate the front and back panels of the display hanger in an attempt to steal the article. In the prior art, a consumer could separate the panels by applying minimal force in order to remove the article undetected. In the present invention, when a consumer attempts to separate the front panel 12 from the rear panel 14, the stress-relief tab 16 makes separation more difficult because the primary stress point is no longer at the leading edge of the adhesive 151 of the stress-relief display hanger 10.

Referring now to FIGS. 4A-4E, there is shown a second exemplary embodiment of the stress-relief display hanger 110 for supporting an article. In this embodiment, the same or similar elements as the embodiment of FIGS. 3A-3E are labeled with the same reference numbers, preceded with the numeral "1". As shown in the figures, the at least one stress-relief tab 116 includes a pair of stress-relief tabs 116 that extend from either edge 114*e* of the rear panel 114 inwardly toward a center of the rear panel 114. The pair of stress-relief tabs 116 may have any of a variety of shapes, which may include a generally angular shape leaving a central, trapezoid shape 119 remaining on the rear panel 114, as shown in the present embodiment. As also described above, each of the pair of stress-relief tabs 116 includes an inner surface 116*a*, an outer surface 116*b* and also includes a hinged portion 118 that allows each of the pair of stress-relief tabs 116 to flex inward, toward the inner surface 112*a* of front panel 112, as described above with reference to the first embodiment.

Each of the pair of stress-relief tabs 116 is flexed inwardly until the inner surface 116*a* of the pair of stress-relief tabs 116 are secured by adhesive to the inner surface 112*a* of the front panel 112. Portions of the rear panel 114 adjacent the pair of stress-relief tabs 116, including the central, trapezoid shape 119 below the upper portion 114*c*, may be intentionally not secured to the front panel in order to better distribute stress to the base 120 of the display hanger. The resulting display hanger likewise displays good adhesive properties with reduced risk of failure, as described herein above.

Figure 5:
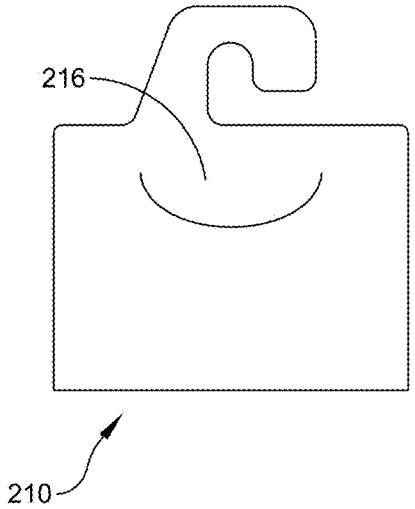
FIG. 5 is a rear elevational view of a third embodiment of a fold-over display hanger of the present disclosure having a stress-relief tab.
Figure 6:
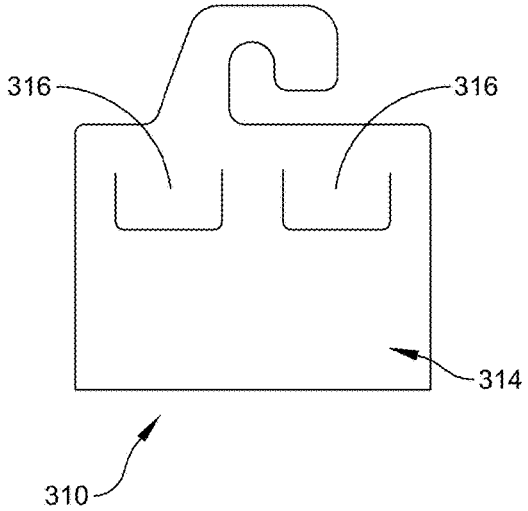
FIG. 6 is a rear elevational view of a fourth embodiment of a stress-relief display hanger of the present disclosure having a pair of stress-relief tabs.
Figure 7:
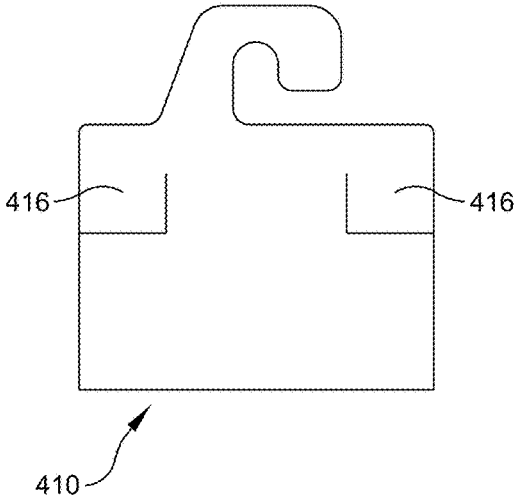
FIG. 7 is a rear elevational view of a fifth embodiment of a stress-relief display hanger of the present disclosure having a pair of stress-relief tabs.
Figure 8:
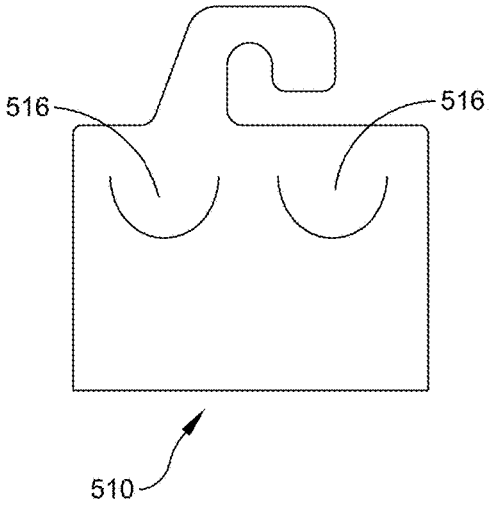
FIG. 8 is a rear elevational view of a sixth embodiment of a stress-relief display hanger of the present disclosure having a pair of stress-relief tabs.
Figure 9A:
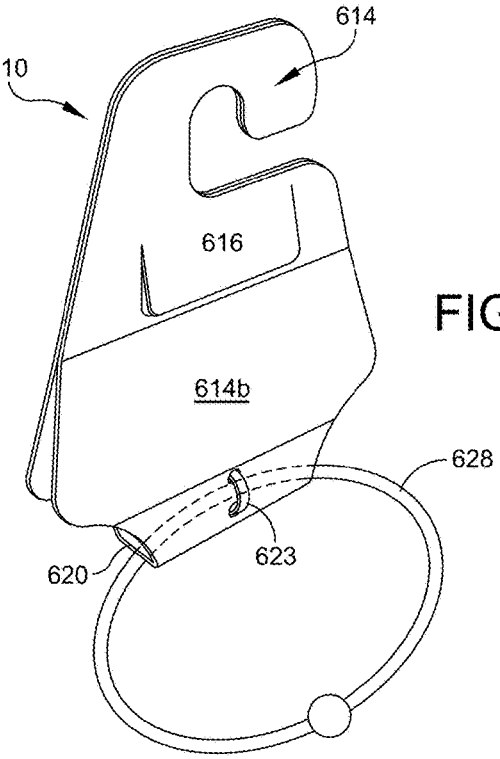
FIG. 9A is a rear perspective view of a seventh embodiment of a stress-relief display hanger having a securing member to secure an article to the stress-relief display hanger.
Figure 9B:
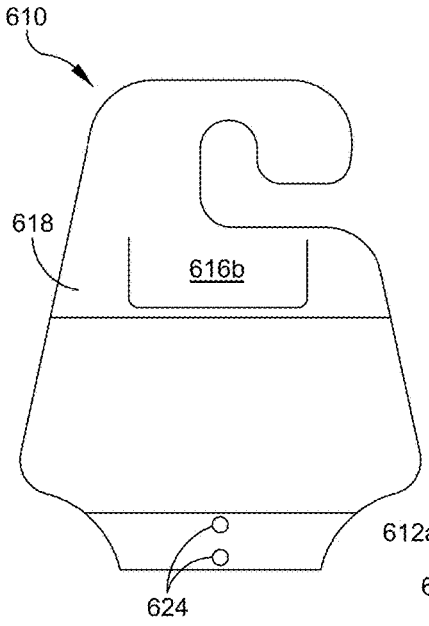
FIG. 9B is a rear elevational view of the embodiment of FIG. 9A.
Figure 9C:
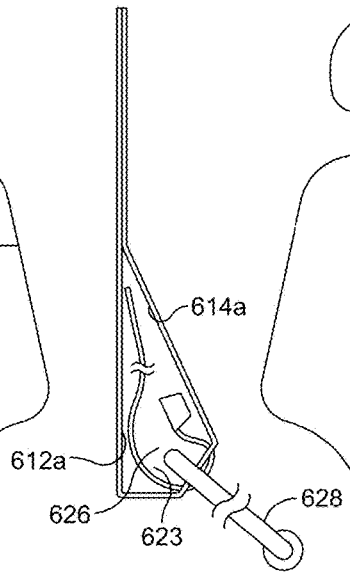
FIG. 9C is a side elevational view of the embodiment of FIG. 9A.
Figure 9D:
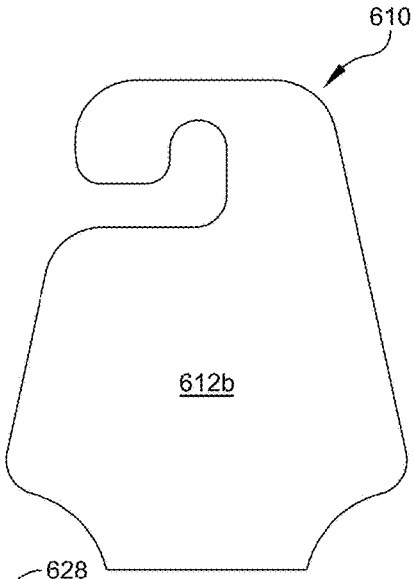
FIG. 9D is a front elevational view of the embodiment of FIG. 9A.
Figure 9E:
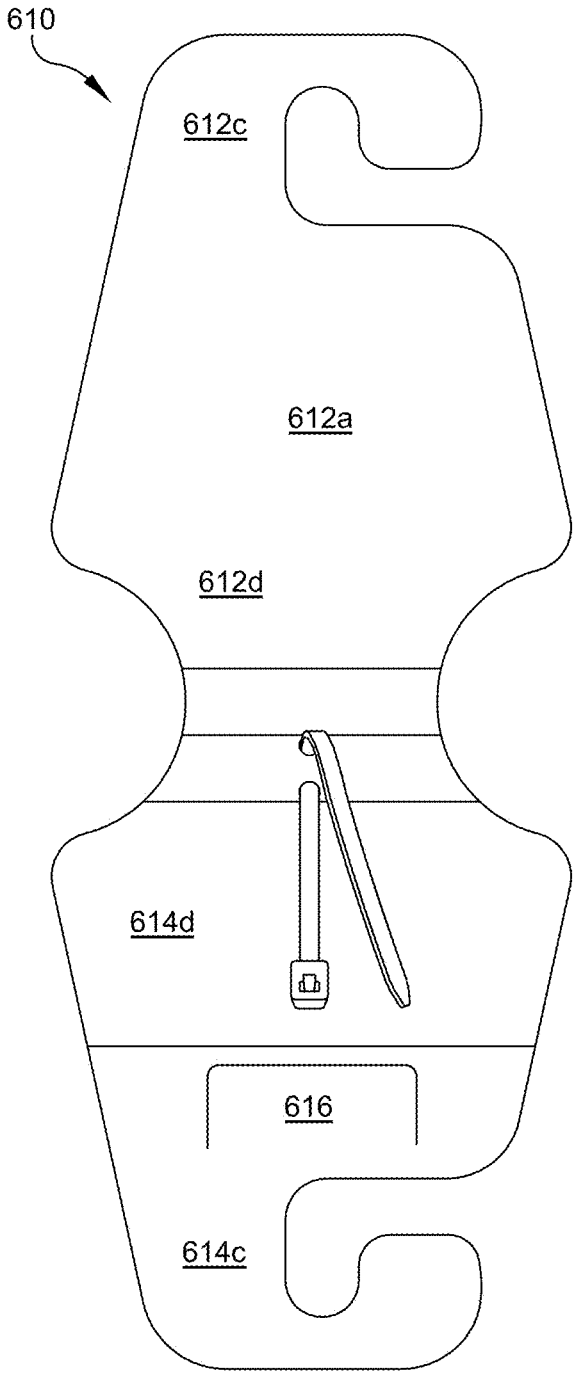
FIG. 9E is an elevational view of the embodiment of FIG. 9A.

Referring now to FIGS. 5-8, there is shown several exemplary embodiments of the stress-relief display hanger for supporting an article as described above with respect to the first and second embodiments. In these embodiments, the same or similar elements as in the previous embodiments are labeled with the same reference numbers, preceded with the numerals "2, 3, 4 and 5", respectively. The only difference in the embodiments of FIGS. 5-8 are the shapes, sizing and positioning of the at least one stress-relief tabs 216, 316, 416, and 516, which are shown for illustrative purposes only as any variety of shapes, sizes and number of tabs may be utilized other than those illustrated. In FIG. 5, a central, generally arcuate stress-relief tab 216 is shown, similar to the stress-relief tab of the first embodiment. In FIG. 6 a pair of generally rectangular stress-relief tabs 316 are shown, centrally located on a larger display hanger 310. The tabs 316 are likewise similar to the stress-relief members of the first embodiment, but include two members instead of one, together being centrally located on rear panel 314. FIG. 7 illustrates a pair of side stress-relief tabs 416 similar to the tabs of embodiment two, but with a more square geometry. In FIG. 8, a pair of generally arcuate stress-relief tabs 516 is shown, centrally located on a larger display hanger 510 similar to the stress-relief tabs of FIG. 7. As will be appreciated, there may be one, two or more stress-relief tabs on a display hanger in various shapes and positions depending on the size of the hanger, and the article to be displayed, the stress-relief tags mitigating the wedge stress effect regardless of the shape, size or location.

Referring now to FIGS. 9A-9E, there is shown a seventh exemplary embodiment of the stress-relief display hanger 610 for supporting an article. In this embodiment, the same or similar elements as described above with respect to the first embodiment are labeled with the same reference numbers, preceded with the numeral "6". As shown and described with respect to the first embodiment, the at least one stress-relief tab 616 is also a single tab that is generally centrally located in the top of the rear panel of the stress-relief display hanger 610. By way of illustration, the stress-relief display hanger 610 has a generally oblong or rectangular shape with rounded corners, but the stress-relief display hanger can take a variety of shapes and sizes and is not limited to a square or rectangular shape. As also described above, the stress-relief tab 616 includes an inner surface 616*a*, an outer surface 616*b* that is secured to the inner surface 612*a* of the front panel 612.

In the present embodiment, the stress-relief display hanger 610 additionally includes a securing member 623 supported thereon to aid in securing the article 628 to the hanger 610. In the present embodiment, the securing member 623 is a cable tie received through a pair of openings 624 in the body of the hanger 610. Alternatively, the securing member 623 may be any type of flexible, tear resistant strap, tie or other element either separate or unitary with the hanger 610, as would be known to those of skill in the art. In the present embodiment, the securing member 623 and openings 624 are located in the lower portion of the rear panel 614*d* adjacent to the base 620, but may alternatively be located anywhere that the inner surfaces 612*a*, 614*a* are not adhered to each other. The securing member 623 and openings 624 may also be located on the base 620. Although received through openings 624 in the present embodiment, the securing member 623 may be secured or supported by the base 620 in alternate ways, including by the use of slots, or adhesive, or by being formed as a single, unitary member as part of the display hanger 610.

Figure 10A:
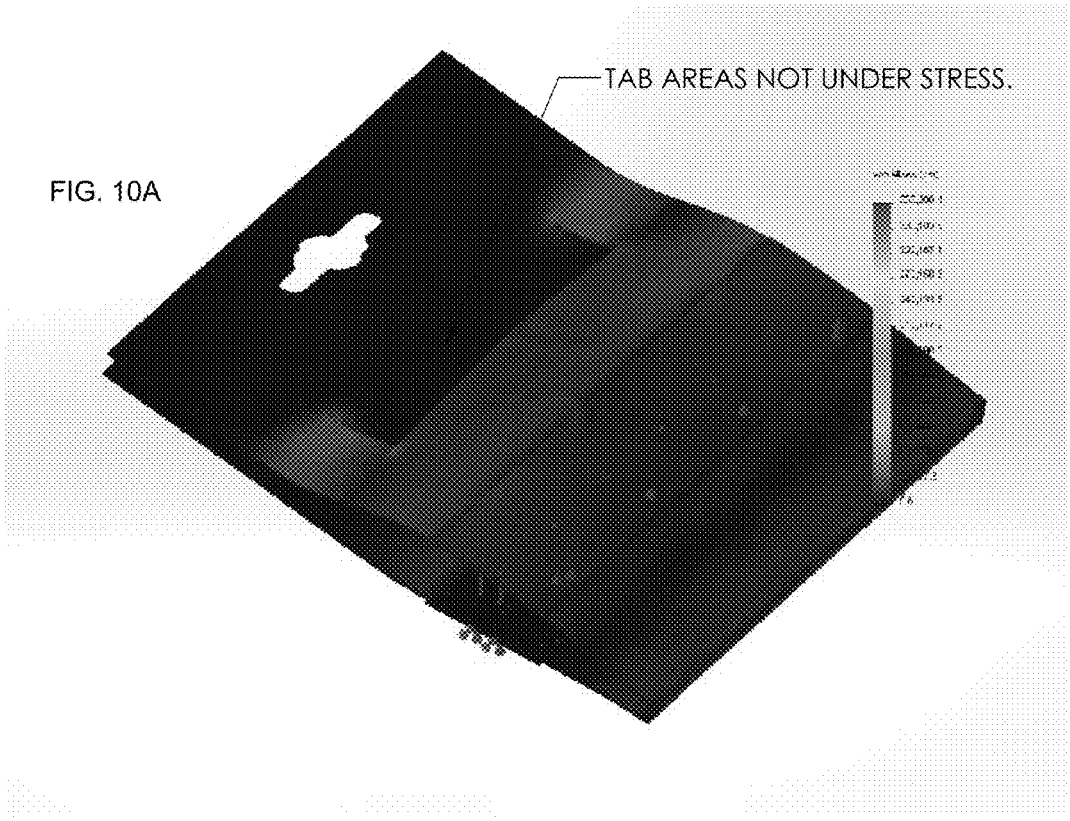
FIG. 10A is a color representation of the rear view of the embodiment of FIG. 3A showing stresses during testing.
Figure 10B:
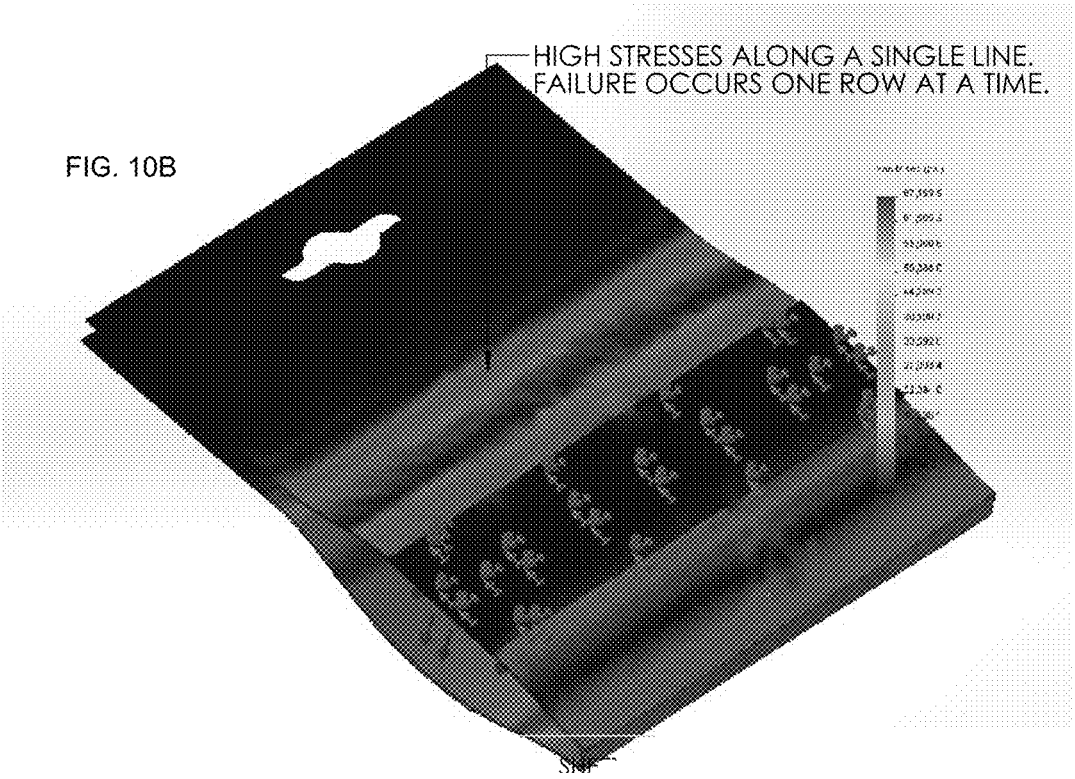
FIG. 10B is a color representation of the rear view of the prior art of FIG. 1A showing stresses during testing and adhesive separation resulting from the stresses.

Referring now to FIGS. 10A and 10B, a comparison showing testing of comparable display hangers in order to test adhesion of a display hanger having a stress-relief tab centrally located (FIG. 10A) and a prior-art display hanger without a stress-relief tab (FIG. 10B), is illustrated. As illustrated, after being subjected to the same amount of stress during testing, FIG. 10A shows no adhesive separation while FIG. 10B has significant adhesive separation resulting from the stresses. Accordingly, the stress-relief display hanger of the present application provides reduced stress at the leading edge of the adhesive that allows for a more secure display tag with reduced chance of failure.

Assembly of the stress-relief display hanger will now be described with reference to FIGS. 2-9E. The article to be displayed may be positioned on the display hanger either prior to or after the hanger is assembled. If placed prior to assembly, the article is positioned at a point that, when assembled, will display the article. For example, in one embodiment, if the article is a necklace, it may be placed where the base 20 of the hanger is located, when assembled. If desired, a securing member 623, which may be a tie or other member as is known in the art, may be provided to further secure the article 628 to the display hanger 10. The securing member 623 may be inserted through a pair of openings 624, provided in or adjacent to the base 20, in order to receive the securing member 623. The securing member is inserted through the pair of openings 624 and through the article 628 and the ends of the securing member 623 are thereafter secured, for example to each other as would be known to those of skill in the art. When the securing member 623 is a cable tie, the leading end of the tie is inserted into the trailing end, and the tie is adjustable in one direction in order to tighten the tie and secure the article, while not allowing removal of the leading end, as is also known in the art.

A portion of the front panel is then secured to a portion of the rear panel of the hanger. To secure the front and rear portions, adhesive 15 is exposed or disposed, for example by removing a protective covering or otherwise applying the adhesive, as known to those of skill in the art. As described above, the adhesive may be positioned on at least the inner surface 16*a* of the at least one stress-relief tab 16, or on the inner surface 12*a* of the panel to which the stress-relief tab 16 is secured during use. Adhesive may additionally be disposed on other portions of the inner surfaces 12*a*, 14*a* of the front and/or rear panels 12, 14 of the display hanger, provided that at least a portion of the lower portion of the front and/or rear panels remain adhesive-free in order to create an opening or void 26 for receiving the article to be supported therein. Once exposed, the inner surface 12*a* of the front panel 12 and the inner surface 14*a* of the rear panel 14 are folded inwardly and secured to each other. The inner surface 16*a* of the at least one stress-relief tab 16 is also secured by the adhesive to the opposing inner surface 12*a* or 14*a* of the panel to which the stress-relief tab 16 is secured during use. When stress is applied to the stress-relief hanger 10, such as through a heavy article 628 or a consumer attempting to remove the article 628, the stress is distributed away from the leading edge of the adhesive 151 eliminating the "wedge effect" allowing the fold over to perform without failure. An EAS marker may additionally be secured to the stress-relief display hanger 10 on any surface to deter theft.

The provision of at least one stress-relief tab moves the stress point away from the leading edge of the adhesive and more evenly distributes the force across a wider area of the base of the display hanger, with no "wedge effect" to cause adhesive separation. The result is that the adhesive is under lower stress thus allowing the fold over to perform without failure in less than desirable situations because the display hanger material becomes the point on failure instead of the adhesive bond.

It will be understood by those skilled in the art that various changes in form and details may be made herein without departing from the spirit and scope of the invention as defined by the appended claims. For example, the materials disclosed herein may be readily changed, as may the dimensions and geometric configurations. The display hanger may be a different configuration other than fold-over hangers, provided there is a front and rear panel secured together that need stress mitigated. If a fold-over hanger is utilized the number of folds, pleats, or creases may range in number, without limitation, and is also not limited to a particular shape, design or style. The stress-relief tab locations and shapes can vary depending upon the design of the display hanger and can be utilized with existing designs of hanger. The disclosure is not limited to any particular display hanger shape or size. In addition, although a hinged portion is shown and described, other ways of allowing the stress-relief tabs disclosed herein to flex inwardly may be provided, including the absence of a hinged portion and flexing by provision of the tab alone. Finally, although shown as a unitary piece, the display hanger may be formed of one or more separate pieces.

What is claimed is:

1. A stress-relief display hanger for supporting an article comprising: a first panel having an inner surface and an outer surface;

a second panel, opposite the first panel, having an inner surface and an outer surface;

an adhesive disposed on a selective area of the inner surface of one of the first and second panel;

at least one stress-relief member disposed in at least one of the first and second panel, the at least one stress-relief member having an inner and outer surface; and wherein the inner surface of the at least one stress-relief member is secured to the opposing inner surface of the other one of the first and second panel in an assembled position such that the at least one stress-relief member is positioned substantially parallel to the other one of the first and second panel, to relieve stress applied to the adhesive during use and discourage separation of the first panel from the second panel, and wherein a lower portion of the first panel and a lower portion of the second panel are paced from one another to create a void for receiving the article to be supported therein.

2. The stress-relief display hanger of claim 1, wherein the at least one stress-relief member includes a hinged portion constructed and arranged to allow movement of the stress-relief member toward the opposing inner surface.

3. The stress-relief display hanger of claim 2, wherein the at least one stress-relief member includes a pair of holes adjacent the hinged portion that are configured and dimensioned to prevent tearing of the stress-relief member.

4. The stress-relief display hanger of claim 1, wherein the at least one stress-relief member is a single stress-relief tab.

5. The stress-relief display hanger of claim 1, further including an EAS marker supported by the display hanger.

6. The stress-relief display hanger of claim 1, wherein the first panel and the second panel each further includes:

a) an upper portion disposed above the at least one stress-relief member;

b) the lower portion disposed below the at least one stress-relief member; and wherein the upper portion of the first panel is secured to the upper portion of the second panel by the adhesive.

7. The stress-relief display hanger of claim 1, wherein at least one stress-relief member has a shape selected from the group comprising an arcuate shape, a rectangular shape, a square shape, an oblong shape and a triangular shape.

8. The stress-relief display hanger of claim 1, wherein the at least one stress-relief member is a pair of stress-relief tabs.

9. The stress-relief display hanger of claim 8, wherein the pair of stress-relief tabs extend from a leading edge of the at least one of the first and second panel.

10. The stress-relief display hanger of claim 1, further including a securing member constructed and arranged to further secure the article to the stress-relief display hanger.

11. The stress-relief display hanger of claim 10, wherein the securing member is a tie.

12. A stress-relief display hanger for supporting an article including: a first panel having an inner surface and an outer surface;

a second panel; opposite the first panel, having an inner surface and an outer surface;

at least one stress-relief member disposed in the second panel, the at least one stress-relief member having an inner surface and an outer surface;

wherein an upper portion of the first panel above the at least one stress-relief member and an upper portion of the second panel above the at least stress-relief member are secured and positioned substantially parallel to one inner surface of one of the first and second panels; and wherein the inner surface of the at least one stress-relief member is secured to the inner surface of the first panel in an assembled position in order to distribute stress across an area of a base of the assembled display hanger and relieve stress applied on the adhesive during use to discourage separation of the first panel from the second panel, and wherein a lower portion of the second panel and a lower portion of the first panel are spaced from each other in order to receive the article to be displayed therein.

13. The stress-relief display hanger of claim 12, wherein the at least one stress-relief member includes a hinged portion constructed and arranged to allow movement of the stress-relief member toward the at least one stress-relief member.

14. The stress-relief display hanger of claim 13, wherein the at least one stress-relief member includes a pair of holes adjacent the hinged portion that are configured and dimensioned to prevent tearing of the stress-relief member.

15. The stress-relief display hanger of claim 12, wherein the at least one stress-relief member is a single stress-relief tab.

16. The stress-relief display hanger of claim 12, wherein the at least on stress-relief member is a pair of stress-relief tabs.

17. The stress-relief display hanger of claim 16, wherein the pair of stress-relief tabs extend from a leading edge of the at least one of the first and second panel.

18. The stress-relief display hanger of claim 12, wherein at least one stress-relief member has a shape selected from the group comprising an arcuate shape, a rectangular shape, a square shape, an oblong shape and a triangular shape.

19. The stress-relief display hanger of claim 12, wherein the upper portion of the first panel is secured to the upper portion of the second panel by the adhesive.

20. The stress-relief display hanger of claim 12, further including a securing member constructed and arranged to further secure the article to the stress-relief display hanger.

21. The stress-relief display hanger of claim 20, wherein the securing member is a tie.

* * * * *